US008347925B2

(12) United States Patent
Li

(10) Patent No.: US 8,347,925 B2
(45) Date of Patent: Jan. 8, 2013

(54) AUTOMATIC FILLING MACHINE FOR RADIOPHARMACEUTICALS

(75) Inventor: Ming-Hsin Li, Taoyuan County (TW)

(73) Assignee: Institute of Nuclear Energy Research, Jiaan Village, Langtan, Taoyuan (TW)

( * ) Notice: Subject to any disclaimer, the term of this patent is extended or adjusted under 35 U.S.C. 154(b) by 747 days.

(21) Appl. No.: 12/543,507

(22) Filed: Aug. 19, 2009

(65) Prior Publication Data

US 2011/0041950 A1 Feb. 24, 2011

(51) Int. Cl.
*B65B 1/04* (2006.01)

(52) U.S. Cl. ..... 141/233; 141/231; 141/232; 141/329; 422/65

(58) Field of Classification Search ..... 141/231–233, 141/329; 422/63, 65, 67, 100
See application file for complete search history.

(56) References Cited

U.S. PATENT DOCUMENTS 4,574,850 A * 3/1986 Davis ..... 141/9
5,067,532 A * 11/1991 Lang et al. ..... 141/329
5,443,791 A * 8/1995 Cathcart et al. ..... 422/65
5,646,046 A * 7/1997 Fischer et al. ..... 436/49
5,660,792 A * 8/1997 Koike ..... 422/63
5,911,252 A * 6/1999 Cassel ..... 141/234
6,722,403 B2 * 4/2004 Zhou et al. ..... 141/129
6,914,555 B2 * 7/2005 Lipscomb et al. ..... 342/124
6,991,002 B2 * 1/2006 Osborne et al. ..... 141/27
7,008,599 B1 * 3/2006 Carlton et al. ..... 422/254
7,804,599 B2 * 9/2010 Calderoni ..... 356/445

* cited by examiner

*Primary Examiner* — Timothy L Maust

(57) ABSTRACT

An automatic radiopharmaceuticals filling machine mainly comprises a main unit with an activation mechanism to perform three-dimensional reciprocal movement. The activation mechanism has a lateral slider that can be activated to move reciprocally along lateral X-axis. On the lateral slider, there is a vertical slider that can extend perpendicularly and move reciprocally along lateral Y-axis. An injection needle is located on the vertical slider and can be activated to move reciprocally along Z-axis perpendicular to the lateral slider. A syringe rack is located in the moving range of the injection needle to accommodate a plural number of syringes, on each of which there is an injection hole. A drug pump has an inlet and an outlet. The inlet connects to a high-dose radiopharmaceuticals drug bottle. The outlet connects to the injection needle. The drug pump withdraws the radiopharmaceuticals from the drug bottle to the injection needle and allows the front end of the injection needle activated to go through the injection hole into the syringe and fill the radiopharmaceuticals into the syringe.

5 Claims, 3 Drawing Sheets

AUTOMATIC FILLING MACHINE FOR RADIOPHARMACEUTICALS

BACKGROUND OF THE INVENTION

1. Field of the Invention

The present invention is related to an automatic filling machine for radiopharmaceuticals. Especially, it refers to an automatic radiopharmaceuticals filling machine that can reduce radiation exposure and increase filling efficiency.

2. Description of the Prior Art

Existing commonly seen radiopharmaceuticals filling machines are mostly designed in small structure for laboratory needs. They are not only difficult to operate but also have limited functions. They cannot operate continuously, so their filling cost is high. Their poor production efficiency makes them unsuitable for mass production.

Thus, the inventor of this invention had a patent with publication number 200909331, which is related to a filling machine. The main unit of the machine comprises a moving mechanism for three-dimensional reciprocal movement, a syringe rack and a drug bottle. The syringe rack can accommodate a plural number of syringes. On the drug bottle rack there is a reversed drug bottle. On the moving mechanism, there are a syringe holder with lateral axis and a syringe activation mechanism. The syringe holder can be activated to hold a syringe and move the syringe to insert its needle into a drug bottle. The syringe activation mechanism can achieve automatic drug filling function by synchronizing the syringe holder's action with drug withdrawal action. However, this type of filling machine that moves different syringes from a syringe rack to a drug bottle and uses a syringe activation mechanism to execute syringe drug withdrawal action is complicated in the overall structure. The development cost is not advantageous. Besides, the movement of the machine is also complicated, so the filling efficiency is poor. There is a need of improvement.

In view of the drawbacks with the traditional radiopharmaceuticals filling machine, the inventor of the present invention came up with this invention to improve over the above-mentioned drawbacks.

SUMMARY OF THE INVENTION

One objective for the present invention is to provide an automatic radiopharmaceuticals filling machine with very simple and logical process to effectively increase production efficiency and meet the requirement in mass production.

The other objective for the present invention is to provide an automatic radiopharmaceuticals filling machine with very simple structure to effectively reduce equipment development and manufacturing cost.

To achieve the above objectives and functions, the technical approaches by the present invention include: a main unit with an activation mechanism to perform three-dimensional reciprocal movement and activate an injection needle to freely move in a predetermined space; a syringe rack located in the moving range of the injection needle by the main unit to accommodate a plural number of syringes, on each of which there is an injection hole; a drug bottle to keep high-dose radiopharmaceuticals; a drug pump with an inlet connecting to the drug bottle and an outlet connecting to the injection needle to withdraw the radiopharmaceuticals from the drug bottle to the injection needle and allow the front end of the injection needle activated by the main unit to go through an injection hole into the syringe and fill the radiopharmaceuticals into the syringe.

According to the above-mentioned structure, the activation mechanism has a lateral slider that can be activated to move reciprocally along lateral X-axis. On the lateral slider, there is a vertical slider that can extend perpendicularly and move reciprocally along lateral Y-axis. The injection needle is located on the vertical slider and can be activated to move reciprocally along Z-axis perpendicular to the lateral slider.

For the detailed structure, application principles, functions and performance, please refer to the following figures and description to obtain complete understanding.

DETAILED DESCRIPTION OF THE EMBODIMENT

Figure 1:
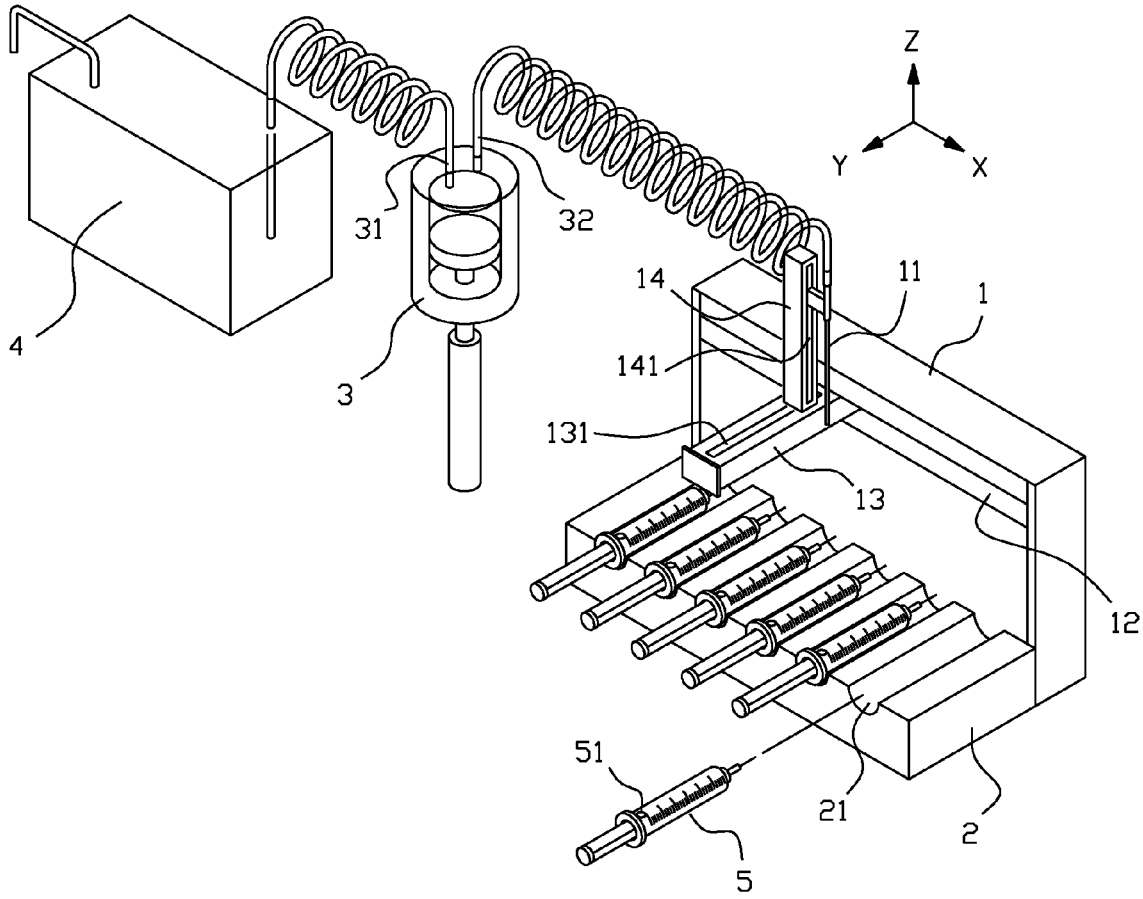
FIG. 1 is the structural diagram for the present invention.

From the figures, it is clear to find that the structure of the present invention mainly comprises: main unit 1, syringe rack 2, drug pump 3 and drug bottle 4. The main unit 1 has an activation mechanism to perform three-dimensional reciprocal movement. The activation mechanism has a lateral slider 13. The lateral slider 13 extends outward from a hollow X-axis guiding groove 12 located on the perpendicular surface of the periphery of the main unit 1, so it can be activated to move reciprocally along lateral X-axis. On the lateral slider 13, there is a hollow Y-axis guiding groove 131. A perpendicular vertical slider 14 can extend outward from the Y-axis guiding groove 131 and be activated to move reciprocally along lateral Y-axis. On the vertical slider 14, there is a hollow Z-axis guiding groove 141. An injection needle 11 is located outside the Z-axis guiding groove 141 and extends parallelly, so the injection needle 11 can be activated to move reciprocally along the Z-axis that is perpendicular to the lateral slider. The syringe rack 2 is located in the moving range of the injection needle 11 by the main unit 1 and has a plural number of positioning concavities 21 to accommodate a plural number of syringes 5. On each syringe 5, there is an injection hole 51. The drug pump 3 has an inlet 31 with a one-way valve and an outlet 32 with a one-way valve. The outlet 32 connects to the injection needle 11. The drug bottle 4 has high-dose radiopharmaceuticals and connects by an output tube to the inlet 31 on the drug pump 3.

Figure 2:
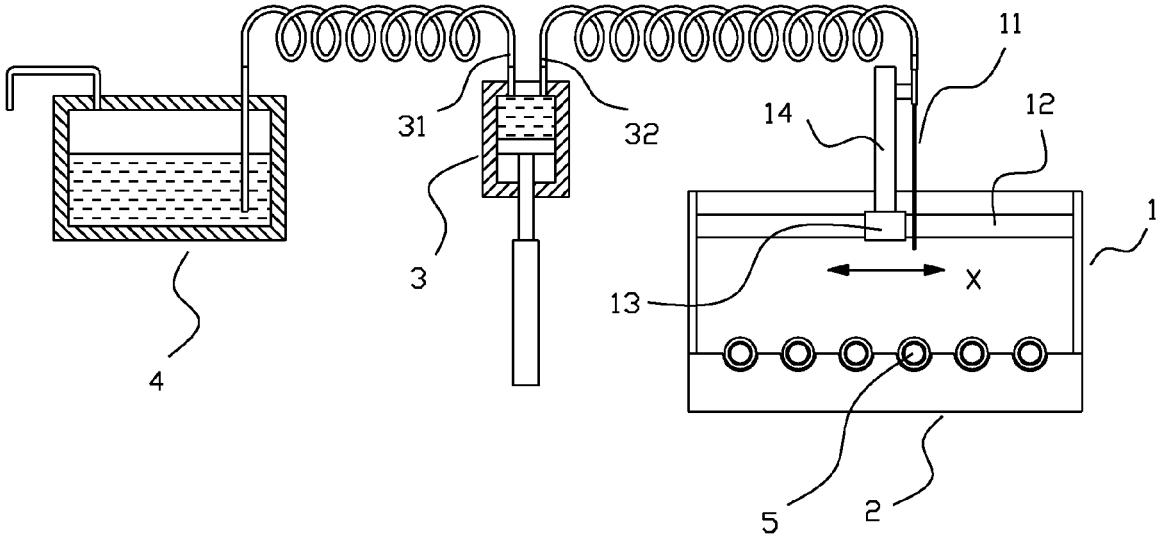
FIG. 2 is the operational diagram (1) for the present invention.
Figure 3:
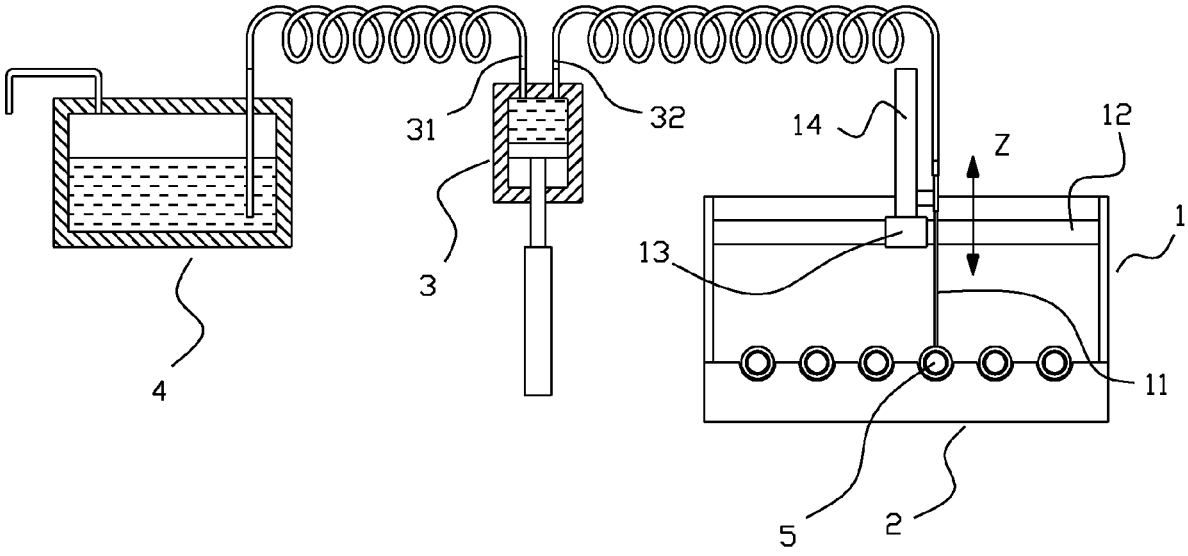
FIG. 3 is the operational diagram (2) for the present invention.

In the operation of the above structure, when the lateral slider 13 of the activation mechanism moves along the X-axis guiding groove 12, it drives the vertical slider 14 and the injection needle 11 to move along the X-axis (as shown in FIG. 2). The vertical slider 14 moves along the Y-axis guiding groove 131 on the lateral slider 13. The injection needle 11 moves along the Z-axis guiding groove 141 on the vertical slider 14 (as shown in FIG. 3). This allows the injection needle 11 to move freely in a predetermined space above the syringe rack 2. Therefore, the injection needle 11 may pass the injection hole 51 into each syringe 5 at different time. Then, the drug pump 3 withdraws the radiopharmaceuticals from the drug bottle 4 to the injection needle 11, through which the radiopharmaceuticals are filled into each syringe 5.

In the above-mentioned structure for the present invention, since the injection needle 11 can move freely in the predetermined space above the syringe rack 2, different setting can be made according to syringe 5 size and specification. So it can meet the operation requirements for syringe 5 with different specifications. Besides, in a practical application, the present invention not only can automatically fill the high-dose radiopharmaceuticals from the drug bottle 4 to a sterile syringe 5 to become a unit-dose syringe, but also produce different drug doses according to individual needs. In compliance with QC equipment and nuclear medicine clinical research, a sterile syringe can be used to fill radioactive nuclide to several reaction bottles and undergo chemical reaction. The application range is very broad. Both the filling rate and the system stability are very excellent. It also shows its value in radiation protection for operators.

From the above description, it is known that the automatic radiopharmaceuticals filling machine in the present invention can substantially reduce equipment investment cost and increase filling efficiency. It has proved its industrial applicability, innovation and progressiveness. However, the above description is only a preferred embodiment of the present invention and is not to limit the scope of the present invention. Those changes and modification according to the claims of the patent application shall be covered by the claims of the present invention.

What is claimed is:

1. An automatic radiopharmaceuticals filling machine at least comprises:

a main unit with an activation mechanism to perform three-dimensional reciprocal movement and activate an injection needle to freely move in a predetermined space, wherein the activation mechanism has a lateral slider that is activated to move reciprocally along lateral X-axis, on the lateral slider, there is a vertical slider extending perpendicularly and moving reciprocally along lateral Y-axis, wherein the injection needle is located on the vertical slider and activated to move reciprocally along Z-axis perpendicular to the lateral slider;

a syringe rack located in the moving range of the injection needle to accommodate a plural number of syringes, on each of which there is an injection hole for filling radiopharmaceuticals;

a drug bottle to keep high-dose radiopharmaceuticals;

a drug pump with an inlet connecting to the drug bottle and an outlet connecting to the injection needle to withdraw the radiopharmaceuticals from the drug bottle to the injection needle and allow the front end of the injection needle activated by the main unit to go through injection hole into the syringe and fill the radiopharmaceuticals into the syringe.

2. According to the description in claim 1 for an automatic radiopharmaceuticals filling machine, wherein on the syringe rack, there are a plural number of positioning concavities and each syringe is kept in the positioning concavity.

3. According to the description in claim 1 for an automatic radiopharmaceuticals filling machine, wherein on a perpendicular side to the syringe rack, the main unit has a hollow X-axis guiding groove and the lateral slider extends out from the X-axis guiding groove.

4. According to the description in claim 1 for an automatic radiopharmaceuticals filling machine, wherein on the lateral slider, there is a hollow Y-axis guiding groove and the vertical slider extends out from the Y-axis guiding groove.

5. According to the description in claim 1 for an automatic radiopharmaceuticals filling machine, wherein on the vertical slider, there is a hollow Z-axis guiding groove and the injection needle is located outside the Z-axis guiding groove and extends parallelly.

* * * * *